US010449564B2

(12) United States Patent
Desrosiers et al.

(10) Patent No.: US 10,449,564 B2
(45) Date of Patent: Oct. 22, 2019

(54) APPARATUS FOR AUTOMATED PRODUCTION OF A ROLL OF WAXED FABRIC

(71) Applicant: ABEEGO DESIGNS INC., Victoria (CA)

(72) Inventors: Toni Marie Desrosiers, Victoria (CA); Liam Ball, Victoria (CA); Adrian Gunstone, Victoria (CA); Jacob Anderson, Victoria (CA); Morgan Charlton, Victoria (CA); Douglas Hinds, Victoria (CA)

(73) Assignee: ABEEGO DESIGNS, INC. (CA)

( * ) Notice: Subject to any disclaimer, the term of this patent is extended or adjusted under 35 U.S.C. 154(b) by 0 days.

(21) Appl. No.: 15/706,553

(22) Filed: Sep. 15, 2017

(65) Prior Publication Data

US 2018/0071768 A1 Mar. 15, 2018

(30) Foreign Application Priority Data

Sep. 15, 2016 (CA) ..... 2942317

(51) Int. Cl.

| | |
|---|---|
| ***B05C 3/12*** | (2006.01) |
| ***B05C 3/00*** | (2006.01) |
| ***B05C 9/12*** | (2006.01) |
| ***B05C 11/02*** | (2006.01) |
| ***B05D 1/18*** | (2006.01) |
| ***D06N 3/00*** | (2006.01) |
| ***D21H 19/18*** | (2006.01) |
| *B05C 9/14* | (2006.01) |

(52) U.S. Cl.

CPC ..... *B05C 3/125* (2013.01); *B05C 3/005* (2013.01); *B05C 9/12* (2013.01); *B05C 11/028* (2013.01); *B05D 1/18* (2013.01); *D06N 3/0086* (2013.01); *D21H 19/18* (2013.01); *B05C 9/14* (2013.01)

(58) Field of Classification Search

None

See application file for complete search history.

(56) References Cited

U.S. PATENT DOCUMENTS 273,013 A * 2/1883 Bedford ..... B21C 47/26 427/398.5

1,824,885 A * 9/1931 Hammond ..... D21H 5/0052 427/209

(Continued)

*Primary Examiner* — Charles Capozzi

(74) *Attorney, Agent, or Firm* — Baumgartner Patent Law; Marc Baumgartner

(57) ABSTRACT

An apparatus for producing a roll of waxed fabric is provided, the apparatus comprising: a frame; a temperature controlled bath at an entrance end of the frame; a squeegee pressed against an exit side of the temperature controlled bath; a cooling tower adjacent the temperature controlled bath, the cooling tower including walls and a manifold to define a cooling zone, the manifold for delivering a flow of air to the cooling zone, a tower roller rotatably mounted above the cooling zone and a lower roller rotatably mounted proximate an exit side of the cooling tower; a blower for delivering air to the manifold; a collection roller rotatably mounted adjacent the alignment roller; a driver roller in rolling engagement with the collection roller; and a motor in mechanical communication with the driver motor for driving the driver motor. A method of producing a roll of waxed fabric is also provided.

14 Claims, 10 Drawing Sheets

(56) References Cited

U.S. PATENT DOCUMENTS

| | | | | | |
|---|---|---|---|---|---|
| 1,968,911 | A * | 8/1934 | Potdevin | D21H 5/0035 | 118/101 |
| 2,081,324 | A * | 5/1937 | Dodge | D21H 5/0052 | 118/419 |
| 2,284,553 | A * | 5/1942 | Bennett | D21H 5/0015 | 118/60 |
| 3,262,688 | A * | 7/1966 | Beggs | C21D 1/667 | 266/113 |
| 3,411,217 | A * | 11/1968 | Daley | F26B 15/128 | 101/115 |
| 2007/0152095 | A1* | 7/2007 | Dumas | B65H 18/08 | 242/541.4 |
| 2010/0129556 | A1* | 5/2010 | Fung | D06M 7/00 | 427/398.1 |
| 2016/0346878 | A1* | 12/2016 | Muraoka | B05C 13/00 | |

* cited by examiner

APPARATUS FOR AUTOMATED PRODUCTION OF A ROLL OF WAXED FABRIC

CROSS REFERENCE TO RELATED APPLICATIONS

This application is related to, and claims the benefit of Canadian Patent Application No. 2,942,317, filed Sep. 15, 2016. The above-identified priority patent application is incorporated herein by reference in its entirety.

FIELD OF THE INVENTION

The present technology relates to an apparatus for applying a wax layer onto and/or impregnate a length of cellulosic sheet or a length of a fabric. More specifically, it is an apparatus that includes a heated bath for immersing the material in, a cooling tower for evenly cooling the waxed material, a pair of alignment rollers, a collection roller and a driver roller.

BACKGROUND OF THE INVENTION

Many food wraps, such as waxed paper, do not adhere to themselves, hence during the manufacturing process, there is no concern that layers will stick together when rolled onto a roll.

The food wraps are also a very consistent thickness. The wraps are also very thin, with the paper in waxed paper in the range of 25 μm thick and the coating a minimal thickness.

In contrast, Abeego® sheets readily adhere to themselves, in fact, this feature is important to their functionality. The Abeego sheets may be as thick as 1 mm. The preferred fabric weight is about 3.5 ounces to about 5.4 ounces. After waxing, the wax may be about 35% to about 60% of the weight of the sheet. These waxed sheets therefore present a number of manufacturing challenges including how to apply the correct amount of wax, how to control cooling of the wax, and how to roll the waxed sheets into a roll without having the layers adhere to one another. It is an object of the present technology to overcome these challenges.

SUMMARY OF THE INVENTION

The present technology provides an apparatus for coating, and impregnating, infiltrating, or infusing paper or fabric. A roll of a material, whether fabric or paper, is placed on a rod that allows it to be fed into a temperature controlled bath of melted wax. Upon exiting the bath, the waxed material passes through a squeegee system to remove excess wax. The waxed material then enters the cooling tower on a first side where a steady and controlled flow of air is delivered through apertures in a manifold housed therein. The rate of cooling is controlled by controlling the speed at which the waxed material travels through the cooling tower and the temperature of the air, which may be regulated. A top roller returns the waxed material to a second side where again, a steady and controlled flow of air is delivered through the apertures in the manifold. The cooling tower promotes efficient and even cooling. The controlled air flow reduces fluttering of the fabric and promotes an even and consistent thickness of the waxed material. The cooled, waxed material is then aligned by a pair of aligning rollers before being rolled on to the collection roller. The collection roller is rotated by a driver roller that sits on the collection roller. The use of the driver roller to draw the material onto the collection roller maintains constant sheet speed as the roll diameter increases, reduces or eliminates tension in the roll of material and reduces or eliminates adhesion between the layers in the roll.

In one embodiment, an apparatus for producing a roll of waxed fabric is provided, the apparatus comprising: a frame; a temperature controlled bath at an entrance end of the frame; a squeegee system located proximate an exit side of the temperature controlled bath; a cooling tower adjacent the temperature controlled bath, the cooling tower including walls and a manifold to define a cooling zone, the manifold for delivering a flow of air to the cooling zone, a tower roller rotatably mounted above the cooling zone; a blower for delivering air to the manifold; a collection roller rotatably mounted adjacent the alignment roller; a driver roller in rolling engagement with the collection roller; and a motor in mechanical communication with the driver motor for driving the driver motor.

In the apparatus, the manifold may include a plurality of straight channels, and a cavity therebelow, the cavity defining a volume, the cavity in fluid communication with the blower and the straight channels, and the straight channels in fluid communication with the cooling zone.

In the apparatus, the volume defined by the cavity may decrease from the blower to an end opposite the blower.

The apparatus may further comprise a lower roller rotatably mounted in the cooling tower proximate an exit side of the cooling tower.

In the apparatus, the cooling chamber may include a first side wall, a second side wall and a back wall.

In the apparatus, the squeegee system may be a squeegee cylinder mounted on a squeegee frame.

In the apparatus, the cooling tower may further include a temperature sensor located in the cooling chamber, the temperature sensor in electronic communication with a speed controller for the driver motor.

The apparatus may further comprise a damper in a duct between the blower and the manifold.

In the apparatus, the driver roller may be mounted at about 30 degrees above a plane defined by a bottom of the collection roller.

The apparatus may further comprise a delivery rod, the delivery roller mounted to the frame proximate the entrance end of the apparatus.

In another embodiment, a method of providing a roll of a waxed material is provided, the method comprising drawing a material through a waxing apparatus with a driver roller, the driver roller located at an exit end of the waxing apparatus and driving a collection roller, the material passing through: i) wax in a heated bath, ii) a squeegee, iii) a cooling tower, and iv) then being rolled on the collection roller, thereby providing a roll of waxed material.

The method may further comprise sensing a temperature in the cooling tower with a temperature sensor and adjusting the speed of the driver roller as needed.

In the method, the material may be cooled in the cooling tower with a flow of air from a manifold in the cooling tower.

In the method cooling the material may further comprise the material passing through an opening between a first arm of the manifold and a second arm of the manifold, over a tower roller and back through the opening.

In yet another embodiment, an apparatus for waxing a fabric is provided, the apparatus comprising: a frame; a temperature controlled bath at an entrance end of the frame; a squeegee pressed against an exit side of the temperature controlled bath; a cooling tower adjacent the temperature controlled bath, the cooling tower including walls, a tower roller rotatably mounted at a top of the cooling tower, and a manifold, the walls and manifold defining a cooling zone, the manifold including a cavity and a plurality of substantially straight channels, the cavity in fluid communication the channels, and the channels in fluid communication with the cooling zone; a blower, the blower in fluid communication with the cavity; and a lower roller, the lower roller located proximate an exit end of the cooling tower.

In the apparatus a volume defined by the cavity may decrease from the blower to an end opposite the blower.

The apparatus may further comprise a collection roller adjacent the cooling tower and proximate an exit end of the apparatus, and a driver for the collection roller.

In the apparatus, the driver may be a roller in rolling engagement with the collection roller and is mounted at about 30 degrees above a plane defined by a bottom of the collection roller.

In yet another embodiment, a method of preparing a roll of waxed fabric is provided, the method comprising using the apparatus described above.

SUMMARY OF THE INVENTION

Figure 1:
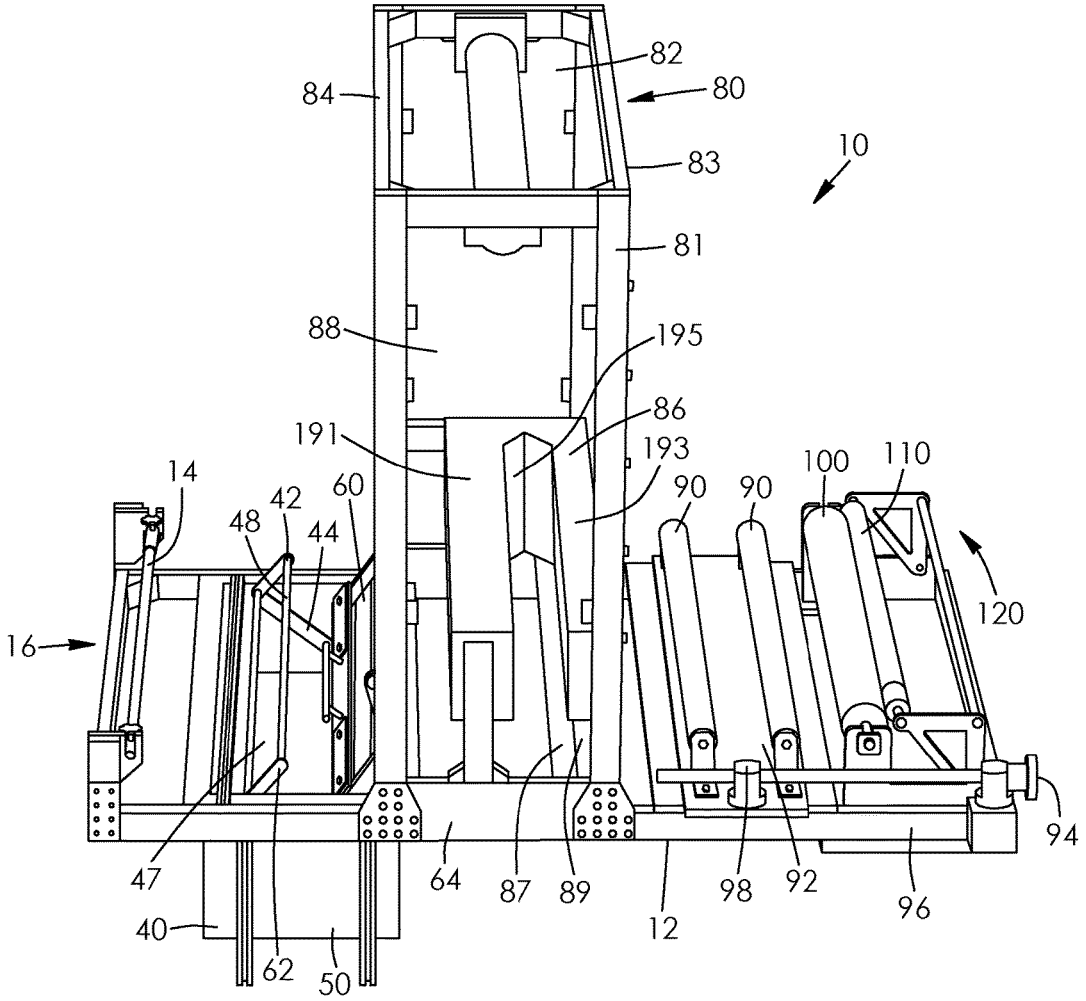
FIG. 1 is a perspective view of the apparatus of the present technology.

Except as otherwise expressly provided, the following rules of interpretation apply to this specification (written description, claims and drawings): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, The terms "comprising," "having," "including," and "containing" are to be construed as open ended terms (i.e., meaning "including, but not limited to,") unless otherwise noted.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

Material—in the context of the present technology, a material is a fabric or paper.

Waxed—in the context of the present technology, a waxed material is one that is coated, and impregnated, infiltrated or infused with wax.

Wax—in the context of the present technology, wax may include for example, but not limited to natural (derived from plants or animals) wax, petrochemical based wax, formulations that may include, for example, but not limited to bees wax, jojoba oil and damar tree resin, mixtures of waxes and mixtures that include at least one wax and retain the characteristics of wax.

DETAILED DESCRIPTION OF THE INVENTION

Figure 2:
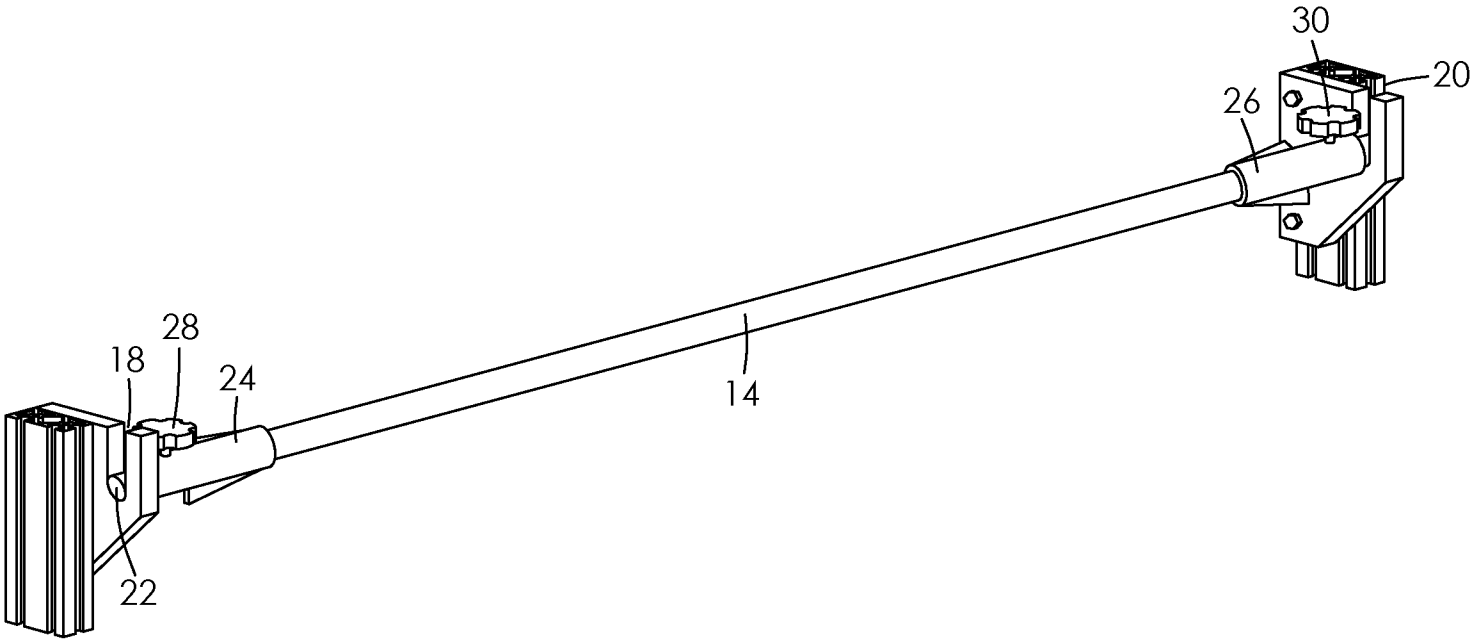
FIG. 2 is a perspective view of the delivery rod assembly of the apparatus of FIG. 1.
Figure 3:
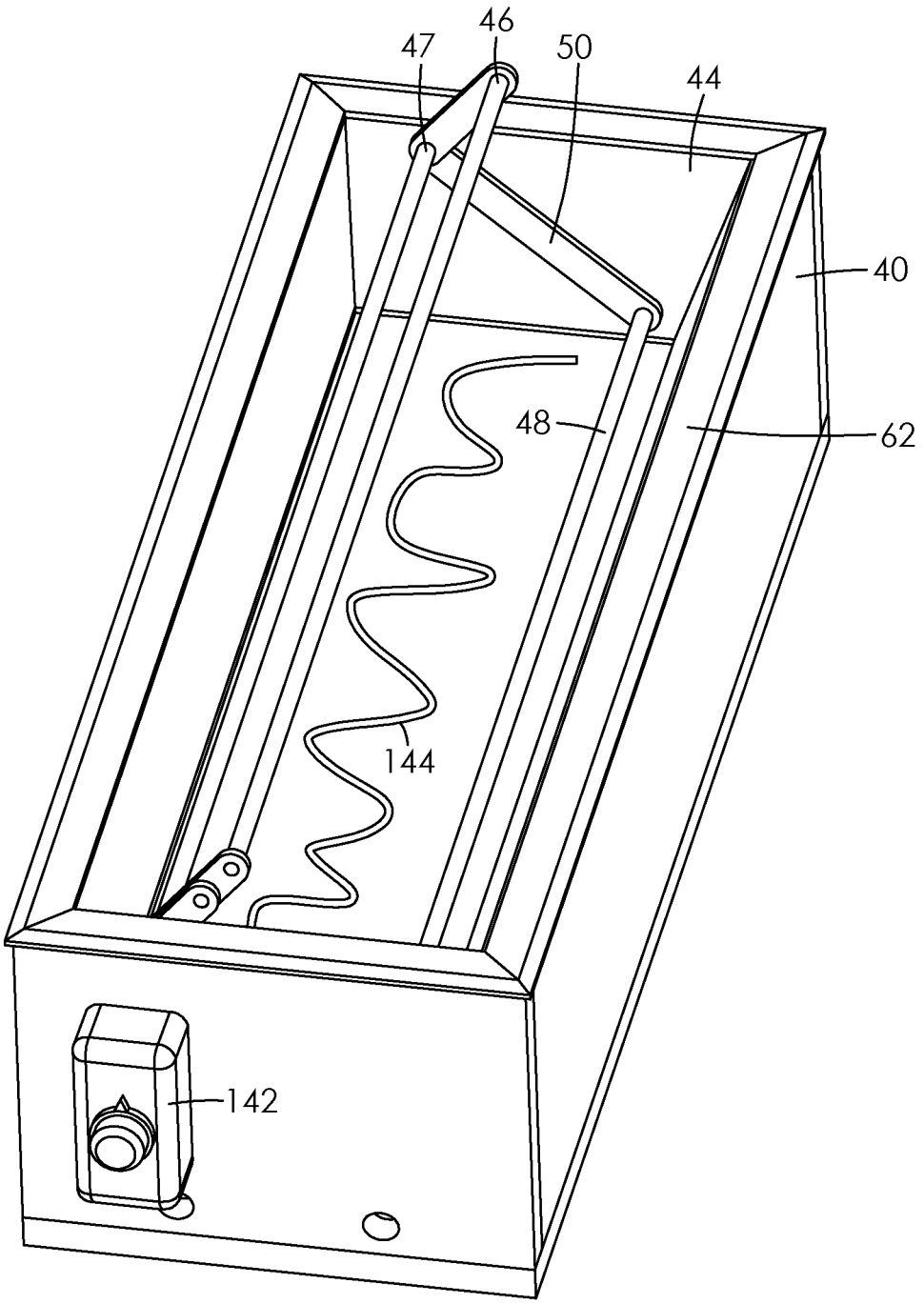
FIG. 3 is a perspective view of the bath of the apparatus of FIG. 1.

A waxing apparatus, generally referred to as 10 is shown in FIG. 1. A frame 12 retains the various components of the apparatus 10. All the components that contact the fabric are silicone coated. A delivery rod 14 is located at an entrance end, generally referred to as 16. As shown in FIG. 2, the delivery rod 14 sits in a right U-shaped receiver 18 and a left U-shaped receiver 20. The ends 22 are preferably flush with the receivers 18, 20. A right centering wedge 24 and a left centering wedge 26 are slidably located about the delivery rod 14 for aligning and retaining a roll of material (fabric or paper). Each centering wedge 24, 26, has a knobbed set screw 28, 30 extending through to retain the centering wedges 24, 26 on the deliver rod 14. Returning to FIG. 1, the deliver rod 14 is located at a distance from a temperature controlled bath 40 to allow for a bolt of fabric or roll of paper to fit. As shown in FIGS. 1 and 3, a feeder 42 is attached to the bath 40 on the interior 44. The feeder 42 includes an upper bar 46 and a lower bar 48 on a framework 50. The framework 50 is pivotally attached to the bath 40 so that the lower bar 48 can be lowered into the bath 40 ensuring that the material to be waxed is sufficiently submersed in the wax.

A squeegee system 60 is also adjustably attached to the bath 40 proximate an exit side 62 of the bath 40, proximate the top 64. The squeegee system 60 extends substantially the width of the bath 40, as does the feeder 42. A cooling tower, generally referred to as 80, is mounted beside the bath 40. The cooling tower 80 includes three walls, a first side wall 81, a second side wall 82, and a back wall 83 a tower frame 84, a tower roller 85, a manifold 86 and a lower roller 87. The position of the lower roller 87 and the back wall 83 can be adjusted upward (away from the frame 12), as needed. The lower roller 87 is proximate an exit end 89 of the cooling tower. The preferred temperature of the cooled fabric 306 is between about 85° F. and about 120° F., preferably about 85° F. and about 110° F. When the fabric is within this temperature range one layer of the roll can slide on another layer without adhering to the other layer, thus it can easily be rolled into a roll. If it's too warm the layers will stick and adhere when cooled. If it is too cool, the layers are tacky and they will not slide well on one another. The manifold 86 and three walls 81, 82, 83 define a cooling zone 88. The walls 81, 82, 83 are preferably transparent and have a low insulation value, for example, but not limited to plexiglass, acrylic or glass.

Adjacent the cooling tower 80 are two alignment rollers 90. These are on a platform 92 that pivots. An adjustment knob 94 and leadscrew 96 rotatably engage a leadscrew mount 98, which is mounted on the frame 12. The leadscrew 96 engages a threaded female member 98 that is attached to the platform 92. Adjacent the alignment rollers 90 is the collection roller 100. The collection roller 100 is rotatably mounted on the frame 12. Abutting the collection roller 100 is the driver roller 110. It is adjustably and rotatably mounted on the frame 12. It is located at the exit end, generally referred to as 120.

Details of Device

As shown in FIG. 3, the temperature controlled bath 40 includes a thermostat 142 and a heating coil 144. The thermostat 142 maintains the temperature within a range of 85° F. and about 110° F., with an accuracy of ±12° F.

Figure 4:
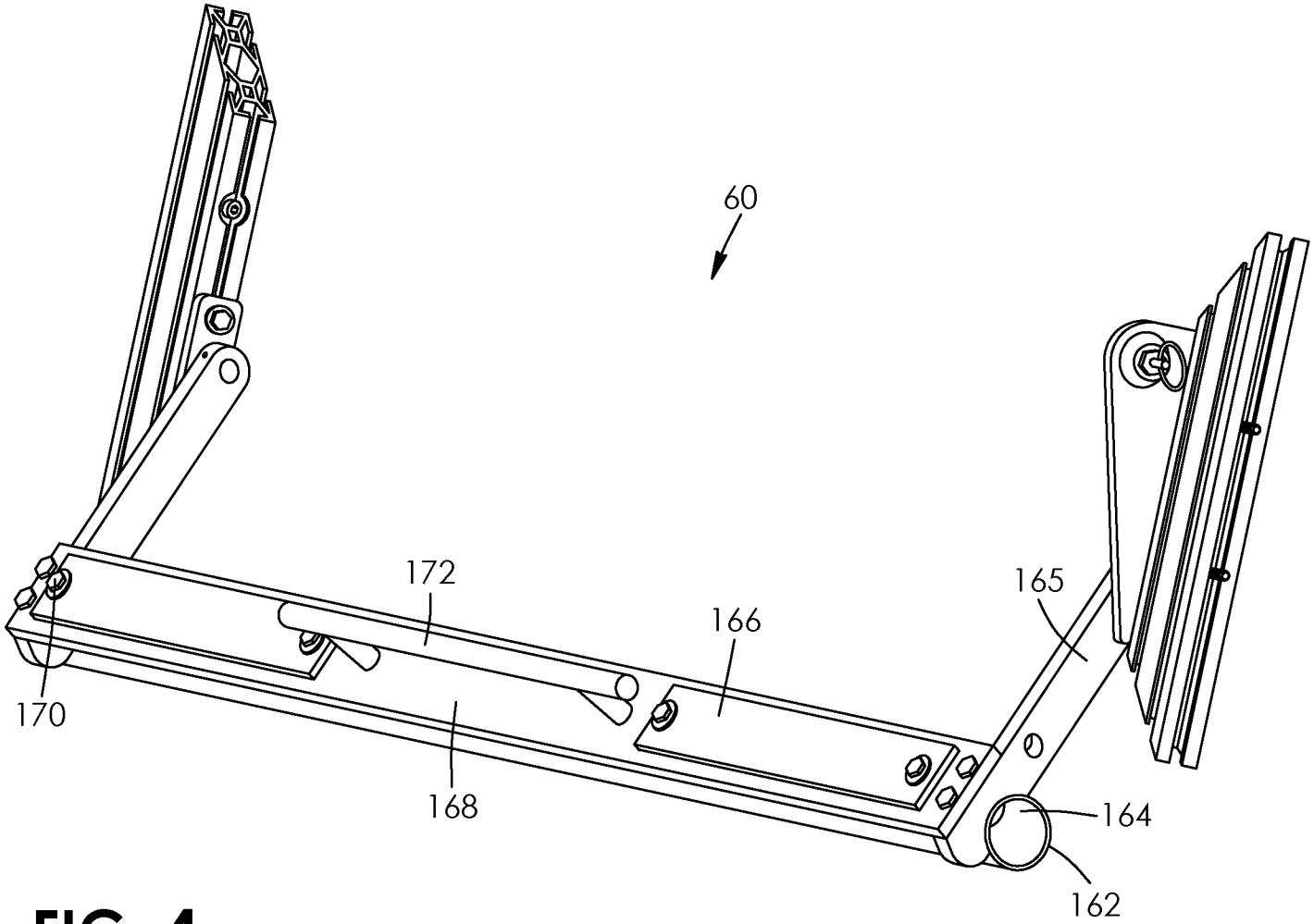
FIG. 4 is a perspective view of the squeegee of the apparatus of FIG. 1.

The squeegee system 60 is shown in FIG. 4. It has a squeegee cylinder 162 mounted on an underside 164 of a squeegee frame 165 for abutting the exit side 62 of the bath 40. Plates 166 are mounted on an upper surface 168 of the squeegee frame 165 to adjust the pressure of the squeegee cylinder 162 on the exit side 62 of the bath 40. The plates 166 are releasably retained with screws 170. A handle 172 is mounted on the upper surface 168 to allow a user to raise and lower the squeegee cylinder 162 and frame 165.

Figure 5:
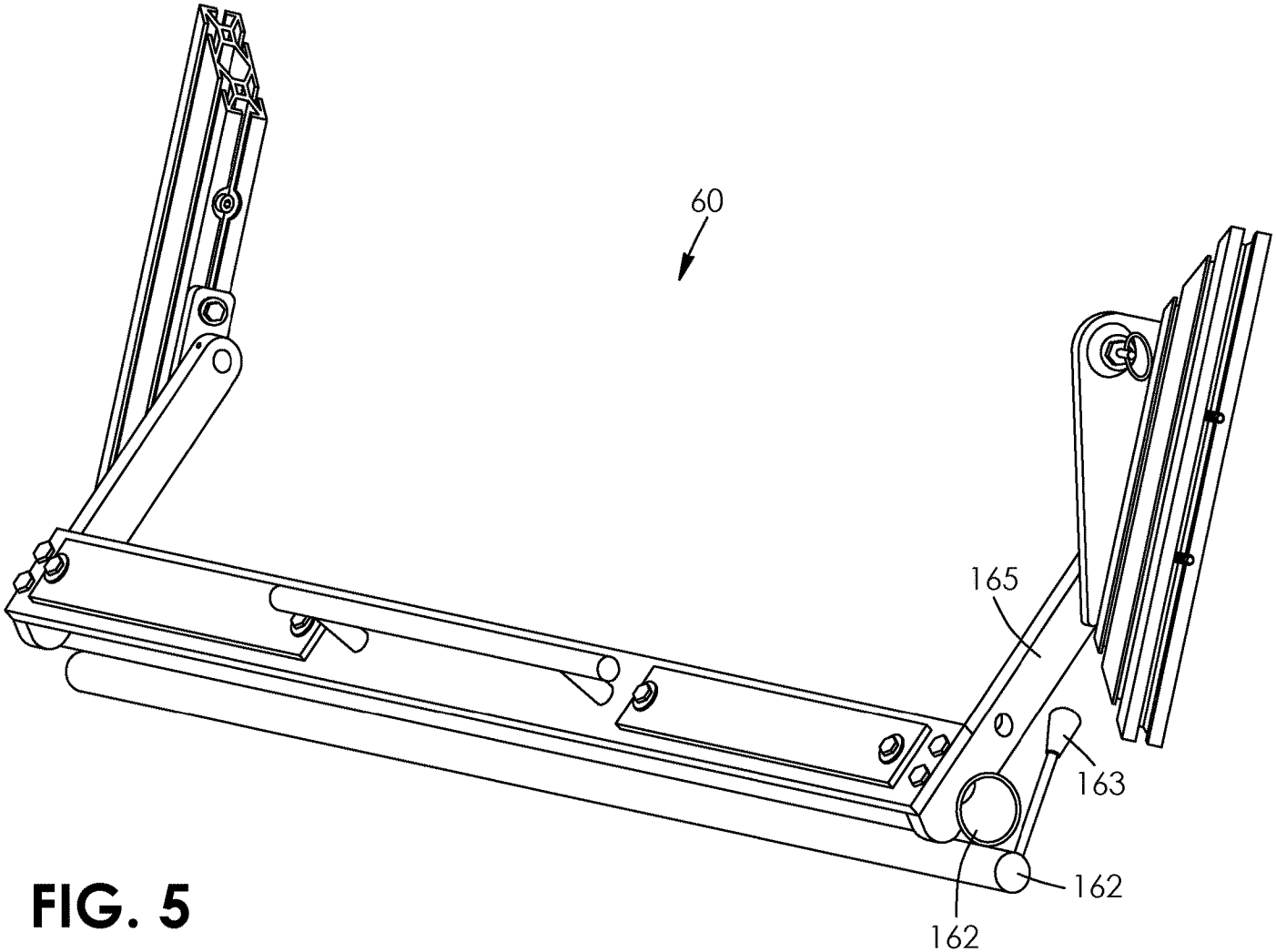
FIG. 5 is a perspective view of an alternative embodiment of the squeegee of FIG. 4.

In an alternative embodiment, shown in FIG. 5, the squeegee system 60 includes two cylinders 162 or squeegees 162 abutting one another. The pressure is adjusted with springs 163, or other suitable biasing member.

Figure 6:
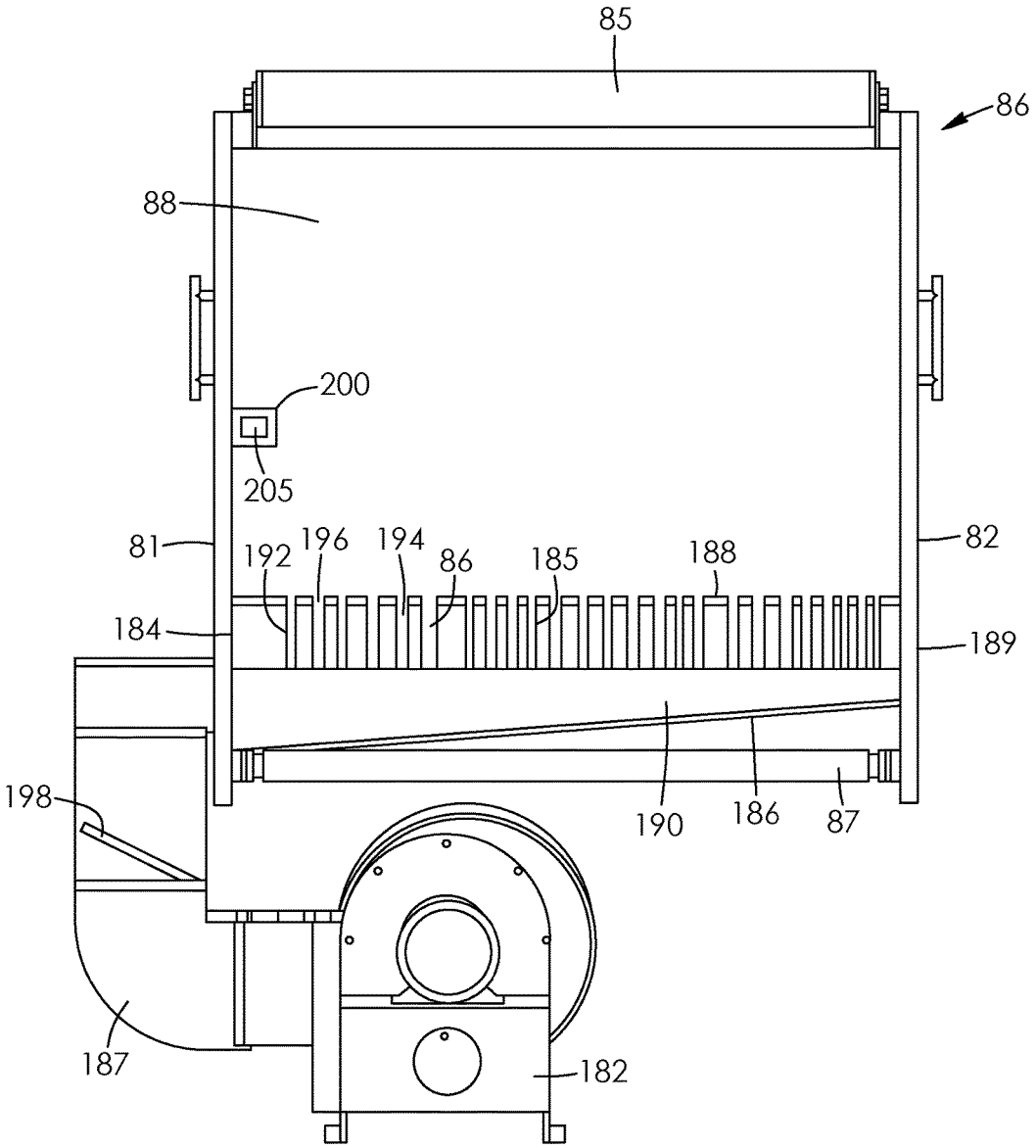
FIG. 6 is a front sectional view of the cooling tower of the apparatus of FIG. 1.

The details of the cooling tower 80 are shown in FIG. 6. The manifold 86 is fed with a 1600 cubic feet per minute (cfm) multi speed blower 182 with an electric motor. The blower 182 is located underneath the cooling tower 80 and delivers air to the back 188 of the manifold through a duct 187. The sides 185 of the manifold decrease in height from the back 184 to the front 189, with the bottom 186 angled upward, to maintain equal pressure throughout the manifold 86. As shown in FIG. 1, the manifold is U-shaped, having a first arm 191 and a second arm 193 with an opening 195 between.

Returning to FIG. 6, the manifold 86 includes a cavity 190 and plastic sheets 192 arranged to provide channels 194 that are about 3 inches to about 5 inches, preferably 4 inches tall extending between and in fluid communication with the cavity 190 and apertures 196 in the top 188. Thus, the apertures 196 in the top 188 of the manifold 86 connect the channels 194 to the ambient environment in the cooling zone 88. The channels 194 straighten the air to decrease eddy currents and increase laminar flow. The cavity 190 is sloped from the back 184 to the front 185 to maintain a consistent air pressure entering the channels. In other words, the volume defined by the cavity 190 decreases from the back 188 (the blower 182) to the end opposite the blower (the front 189) A damper 198 in the ducting 187 further controls the airflow. A temperature sensor, which is preferably an infrared sensor 200, is mounted on the cooling tower 80 and extends into the cooling zone 88. It is in electronic communication with a speed controller 202 on the drive motor 204. The temperature sensor includes a Liquid Crystal Display (LCD) 205. Alternatively, the speed can be manually controlled.

Figure 7:
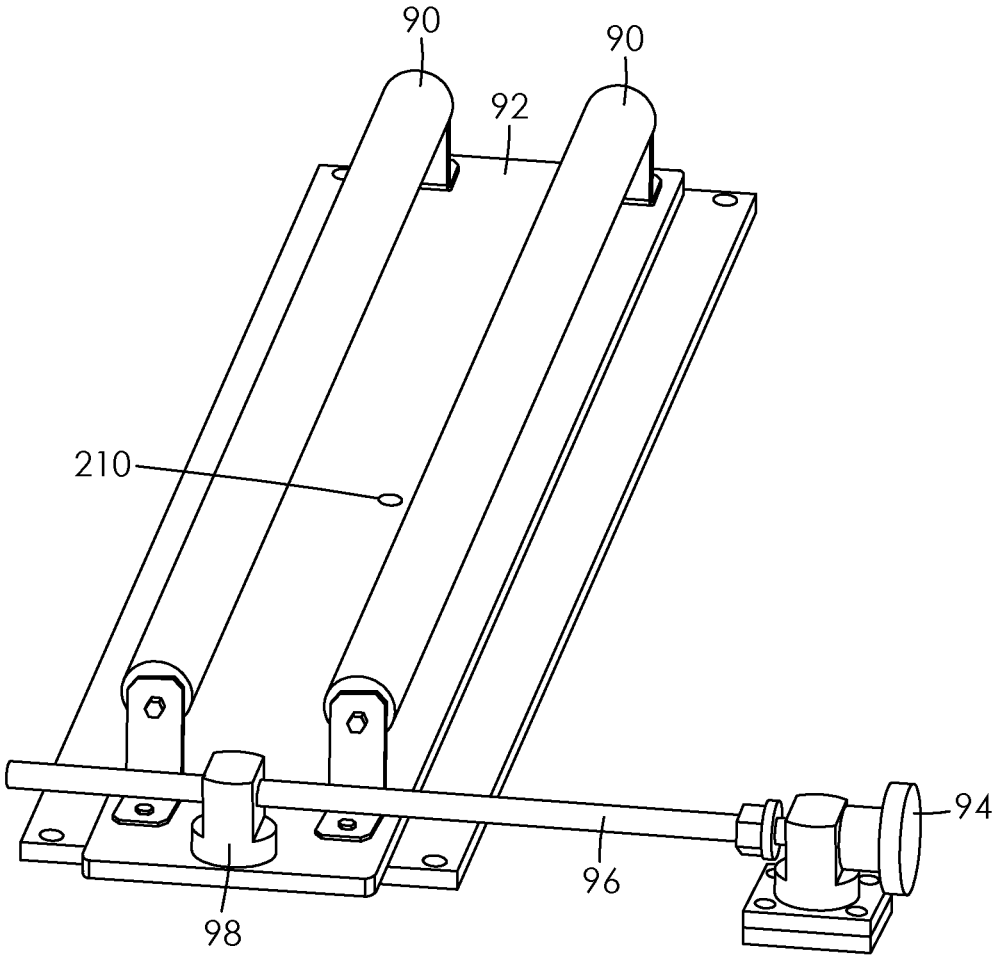
FIG. 7 is a perspective view of the alignment rollers and platform of the apparatus of FIG. 1.

As shown in FIG. 7, the alignment rollers 90 and the platform 92 pivot about a pivot mount 210. The pivot mount 210 is located in the centre of the platform 92. In one embodiment, the pivoting platform controller is an adjustment knob 94 and lead screw 96. The lead screw 96 engages a threaded female member 98 that is attached to the platform 92.

In an alternative embodiment the pivoting platform controller may be automated and include a camera or other a position sensor in electronic communication with an automatic lead screw, hydraulic ram, pneumatic ram or the like as would be known to one skilled in the art.

Figure 8:
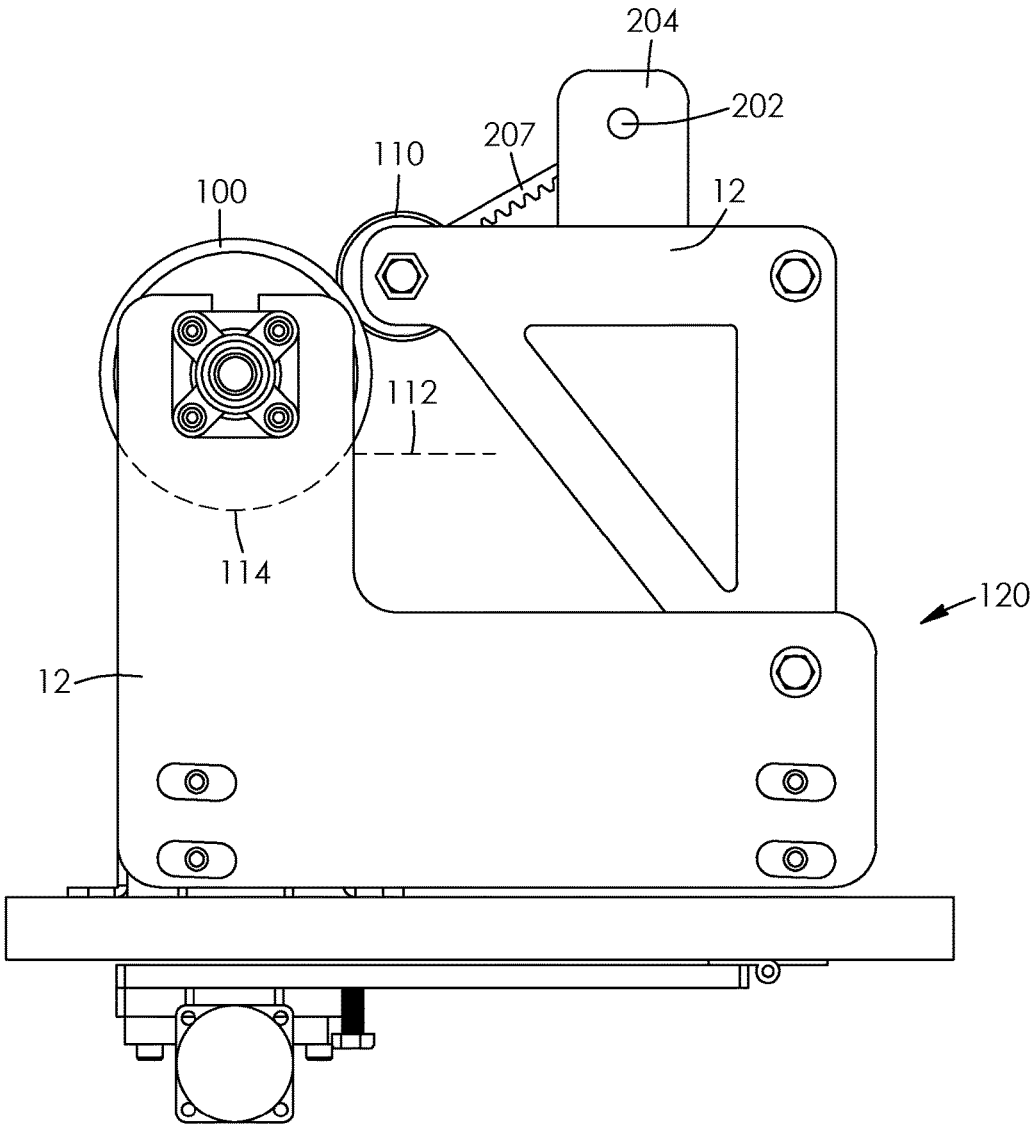
FIG. 8 is a side view of the collection roller and driver roller of the apparatus of FIG. 1.

As shown in FIG. 8, the collection roller 100 is rotatably mounted on the frame 12. Abutting the collection roller 100 is the driver roller 110, which is in rotatable engagement with the collection roller 100. It is adjustably and rotatably mounted on the frame 12, and is preferably located about 30 degrees above the plane 112 defined by the bottom 114 of the collection roller 100 and floats on the collection roller 100. It is located at the exit end 120.

The driver roller 110 is in mechanical communication with a drive motor 204 via a synchronous cog belt 207. As noted above, the motor 204 has a speed control 202 so that the speed that the fabric is drawn through the apparatus 10 can be varied as needed.

Figure 9:
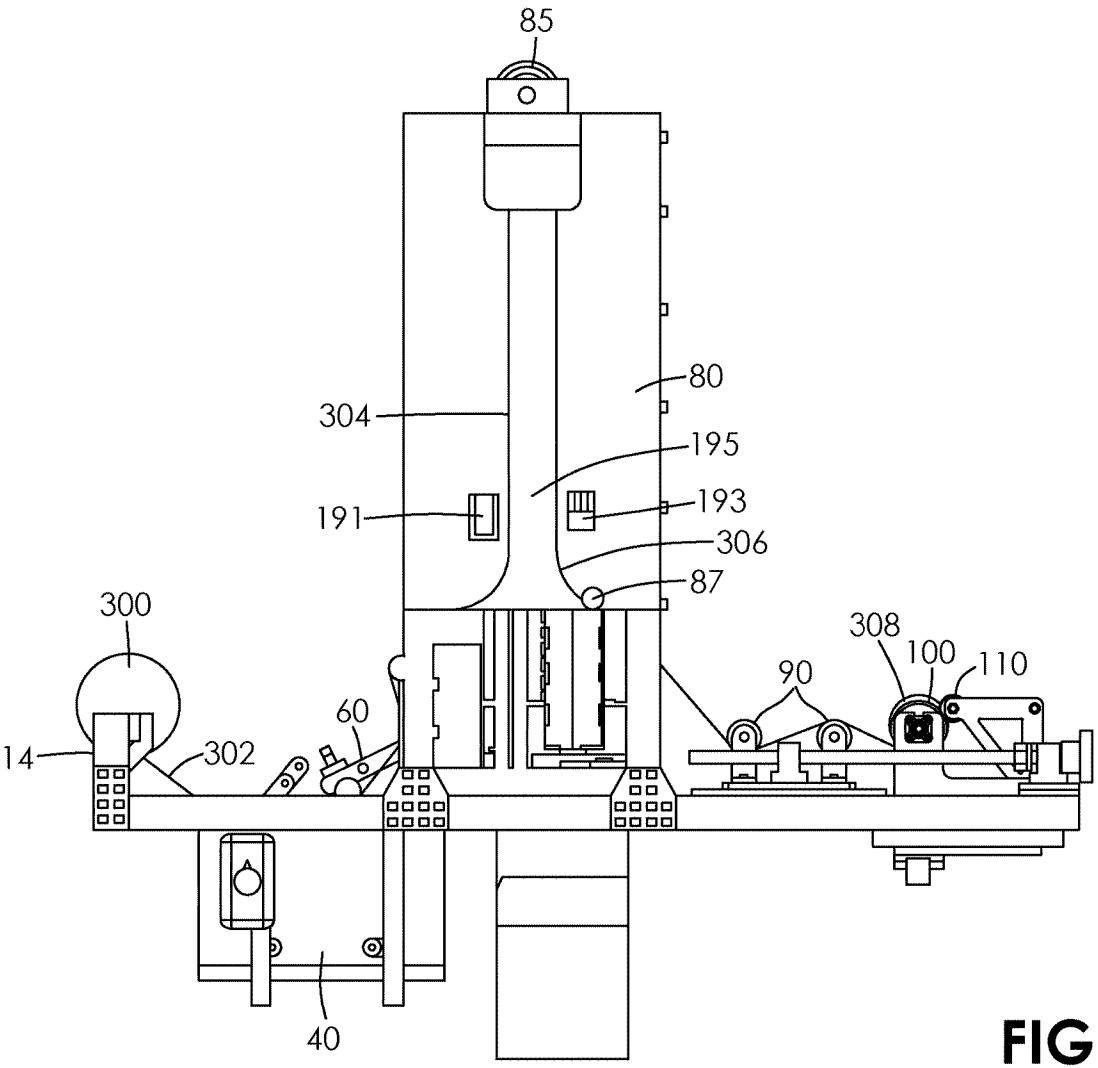
FIG. 9 is a side view of the apparatus of FIG. 1, in use.

As shown in FIG. 9, in operation, a roll 300 of uncoated fabric 302 is loaded onto the delivery rod 14 and is fed through the bath 40, cooling tower 80 and on to the collection roller 100. The drive motor 204 is then started and the fabric is drawn through the apparatus 10 by the driver roller 110 rotating the collection roller 100. As the fabric leaves the bath 40, the squeegee 60 removes excess wax and ensures that the depth of the wax is consistent on the surface of the waxed fabric 304. The waxed fabric 304 is then fed into a cooling tower 80. It travels between the first arm 191 and the second arm 193 through the opening 195 defined by the arms, travels over the tower roller 85 and down through the opening 195 between the first arm 191 and second arm 193, then around the lower roller 87. The manifold 86 provides a constant and very diffuse airflow in the cooling zone 88. The design of the manifold 86 with its straight channels 194 minimizes unwanted movement of the fabric, for example fluttering. The air flow is laminar and consistent in pressure so that the air velocity exiting the manifold is consistent across the entire manifold. This promotes a consistent depth of wax on the fabric. The air in the manifold 86 is higher pressure than ambient because of the blower 182. The sloped cavity 190 in the manifold 86 (decreasing in depth from the back 184 to the front 189) causes the pressure to be equalized throughout the manifold 86, and hence the airflow through the apertures 196 is consistent over time and over area. In addition, the damper 198 in the ducting 187 further controls the air speed to promote equalized air flow over the sheets as they cool. The temperature in the cooling zone 88 is monitored with the infrared sensor 196. If the temperature is outside of the acceptable range, the drive motor 204 speed will be adjusted with the speed controller 202 to alter the speed that the waxed fabric 304 moves through the cooling tower 80. The cooling tower 80 is designed such that the initial cooling on the first side is reduced to the acceptable temperature for contact with the tower roller 85 and the second pass completes the cooling to the acceptable range for rolling the waxed and cooled fabric 306. As noted above, the position of the lower roller 87 can be adjusted as needed to assist in cooling the fabric to an acceptable temperature. The waxed and cooled fabric 306 pass through the alignment rollers 90. The platform 92 is pivoted as needed using the adjustment knob 94 to align the waxed and cooled fabric 306 to roll evenly on the collection roller 100. As the driver roller 110 floats on the collection roller 100, a consistent force is exerted on the fabric roll 308 as it increases in diameter. This reduces the chance of the layers of the roll adhering to one another.

Figure 10:
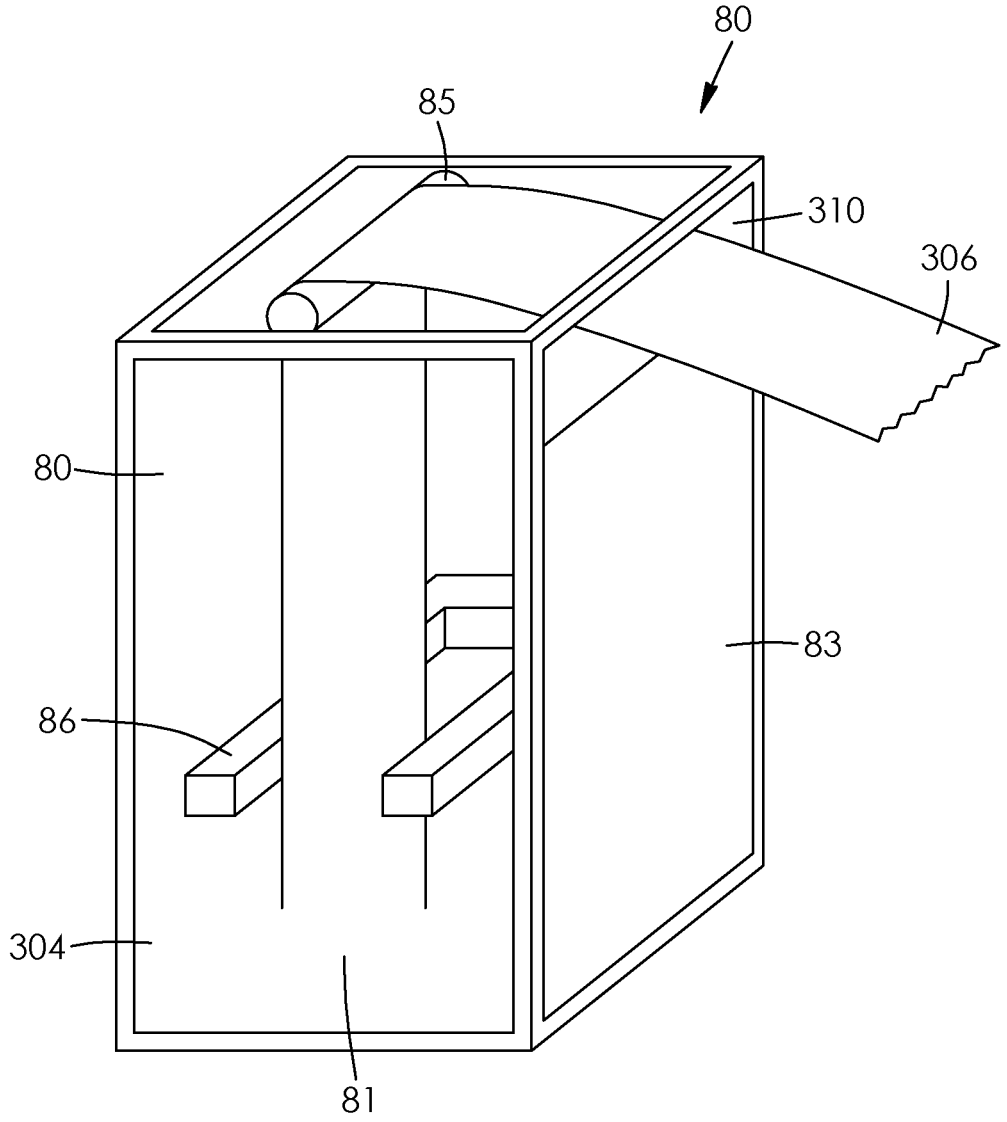
FIG. 10 is a perspective view of an alternative embodiment of the cooling tower of FIG. 6.

A shown in FIG. 10, in an alternative embodiment, designed for different products to be manufactured, the lower roller 87 is dispensed with and the fabric 306 is fed directly from the tower roller 85 to the alignment rollers 90. The back wall 83 of the cooling tower 80 includes a slot 310 for the cooled and waxed fabric 306 to travel through.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize, or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. An apparatus for producing a roll of waxed fabric, the apparatus comprising: a frame; a temperature controlled bath at an entrance end of the frame; a squeegee system located proximate an exit side of the temperature controlled bath, the squeegee system including a squeegee cylinder which abuts an exit side of the temperature controlled bath; a cooling tower adjacent the temperature controlled bath, the cooling tower including walls and a U-shaped manifold to define a cooling zone, the manifold for delivering a controlled flow of air to the cooling zone, a tower roller rotatably mounted above the cooling zone; a blower for delivering air to the manifold; a platform which includes a pivot mount pivotally attaching it to the frame adjacent the cooling tower; at least one alignment roller; the at least one alignment roller mounted on the platform; a collection roller rotatably mounted adjacent the alignment roller; a driver roller in rolling engagement with the collection roller; and a motor in mechanical communication with the driver roller for driving the driver roller.

2. The apparatus of claim 1, wherein the manifold includes a plurality of straight channels, and a cavity therebelow, the cavity defining a volume, the cavity in fluid communication with the blower and the straight channels, and the straight channels in fluid communication with the cooling zone.

3. The apparatus of claim 2, wherein the volume defined by the cavity decreases from the blower to an end opposite the blower.

4. The apparatus of claim 3, further comprising a lower roller rotatably mounted in the cooling tower proximate an exit side of the cooling tower.

5. The apparatus of claim 4, wherein the cooling tower further includes a temperature sensor located in the cooling zone, the temperature sensor in electronic communication with a speed controller for the motor.

6. The apparatus of claim 5, further comprising a damper in a duct between the blower and the manifold.

7. The apparatus of claim 6, wherein the manifold is shaped to provide a laminar flow of air.

8. The apparatus of claim 7, wherein the driver roller is mounted at about 30 degrees above a plane defined by a bottom of the collection roller.

9. The apparatus of claim 8, further comprising a delivery rod, the delivery rod mounted to the frame proximate the entrance end of the frame.

10. An apparatus for waxing a fabric, the apparatus comprising: a frame; a temperature controlled bath at an entrance end of the frame; a squeegee pressed against an exit side of the temperature controlled bath; a cooling tower adjacent the temperature controlled bath, the cooling tower including walls, a tower roller rotatably mounted at a top of the cooling tower, and a manifold, the walls and manifold defining a cooling zone, the manifold including a cavity and a plurality of substantially straight channels, the cavity in fluid communication with the channels, and the channels in fluid communication with the cooling zone; a blower, the blower in fluid communication with the cavity; a lower roller, the lower roller located proximate an exit end of the cooling tower; a collection roller rotatably mounted adjacent the lower roller; a driver roller in rolling engagement with the collection roller; a motor in mechanical communication with the driver roller for driving the driver roller; and a platform which includes a pivot mount pivotally attaching it to the frame adjacent the cooling tower, between the lower roller and the collection roller and at least one alignment roller, which is mounted on the platform.

11. The apparatus of claim 10, further comprising a pivoting platform controller.

12. The apparatus of claim 11, wherein the pivoting platform controller is an adjustment knob and lead screw, the lead screw engaging a threaded female member that is attached to the platform.

13. The apparatus of claim 1, further comprising a pivoting platform controller.

14. The apparatus of claim 13, wherein the pivoting platform controller is an adjustment knob and lead screw, the lead screw engaging a threaded female member that is attached to the platform.

* * * * *